US005915805A

United States Patent [19]

Lee

[11] Patent Number: 5,915,805

[45] Date of Patent: Jun. 29, 1999

[54] DOOR HANDLE ASSEMBLY FOR REFRIGERATOR

[75] Inventor: Yeon-Hak Lee, Suwon, Rep. of Korea

[73] Assignee: Samsung Electronics Co., Ltd., Kyungki-Do, Rep. of Korea

[21] Appl. No.: 08/955,245

[22] Filed: Oct. 21, 1997

[30] Foreign Application Priority Data

Oct. 25, 1996 [KR] Rep. of Korea ..... UM9635545 U
Oct. 25, 1996 [KR] Rep. of Korea ..... UM9635546 U
Oct. 25, 1996 [KR] Rep. of Korea ..... UM9635547 U

[51] Int. Cl.[6] ..... A47B 95/00

[52] U.S. Cl. ..... 312/405; 292/251.5; 312/296

[58] Field of Search ..... 312/405, 401, 312/222, 296; 49/478.1, 319, 489.1; 292/DIG. 71, 251.5, 182, DIG. 19; 62/440

[56] References Cited

U.S. PATENT DOCUMENTS 2,659,115 11/1953 Anderson et al. ..... 292/251.5 X
2,970,857 2/1961 Squire ..... 292/251.5
3,195,880 7/1965 Ritchey ..... 292/251.5 X
4,590,710 5/1986 Newland ..... 49/478.1

FOREIGN PATENT DOCUMENTS 2-33115 9/1990 Japan .

*Primary Examiner*—Peter M. Cuomo
*Assistant Examiner*—Janet M. Wilkens
*Attorney, Agent, or Firm*—Burns, Doane, Swecker & Mathis, L.L.P.

[57] ABSTRACT

A refrigerator includes a main body, a door hinged to the main body, a gasket sealingly disposed between the main body and the door when the door is closed, and a handle assembly mounted on the door for enabling a user to open the door. The handle assembly includes an actuator which is movable relative to the door in response to being pulled by the user, and an operating member movable relative to the actuator. The operating member is operably connected to the actuator to be moved thereby into contact with the body for creating a force tending to separate the gasket from the body.

15 Claims, 10 Drawing Sheets

DOOR HANDLE ASSEMBLY FOR REFRIGERATOR

BACKGROUND OF THE INVENTION

1. Field of the Invention

The present invention relates to a door handle assembly for refrigerators which keep foods and beverages in a frozen or very low temperature state to preserve their freshness.

2. Description of Related Art

Various door assemblies having a door handle for a refrigerator have been proposed.

Japanese Utility Model Publication No. 2-33115 discloses an example of a door assembly shown in FIGS. 1, 2 and 3.

As shown in the drawings, the door assembly comprises a door body 2 having a heat insulating core 6 and front and rear surface plates 3 and 4 covering the heat insulating core 6; and a gasket 7 mounted on a rear portion of the door body 2 for sealing the interior of the refrigerator by contacting a main body 1 of the refrigerator when the door assembly is closed. The gasket 7 is mounted on a connecting member 5 connecting a flange portion 3A of the plate 3 to the plate 4. The connecting member 5 is made of a synthetic resin and includes a groove 8 into which a base portion of the gasket 7 is inserted and supported, and a channel 12 fixedly inserted into a recess 11 formed on the rear portion of the heat insulating core 6. A coating seat 16 is coated on a surface of the heat insulating core 6 corresponding to the connecting member 5. Two connecting members 5 (and associated gaskets 7) can be in perpendicular relationship by means of a connecting piece 13 shown in FIG. 3.

A magnet 10 is installed in the gasket 7 so that the door 2 can tightly contact the main body 1, thereby preventing leakage of cooled air when the door assembly is closed.

In the above described door assembly, a handle 20 (see FIG. 2) is attached on the door body 2 and is not in cooperation with the gasket 7.

Since the gasket 7 is tightly contacted with the main body 1, an excessive amount of force must be exerted by the user to open the door to release the gasket 7 from the main body 1.

SUMMARY OF THE INVENTION

Therefore, the present invention has been made in an effort to solve the above described prior art problems.

It is an object of the present invention to provide a handle assembly which can cooperate with a gasket, thereby allowing the door of the refrigerator to be easily opened.

To achieve the above object, the present invention involves a refrigerator comprising a main body, a door hinged to the main body, a gasket disposed between the main body and the door when the door is closed, and a handle assembly mounted on the door for enabling a user to open the door. The handle assembly includes an actuator and a operating member. The actuator is movable relative to the door in response to being pulled by the user. The operating member is movable relative to the actuator, and is operably connected to the actuator to be moved thereby against the body for creating a force tending to separate the gasket from the body.

Preferably, the actuator comprises a lever mounted to the door for rotary movement relative thereto. The door assembly further includes a force transmitting mechanism operably connected between the lever and operating member for converting rotary movement of the lever into linear movement of the operating member.

Preferably, the force transmitting mechanism comprises a pivot member mounted on the door for rotation relative thereto. The pivot member is operably connected to the lever for being rotated thereby and is operably connected to the operating member for linearly movingly operating member in response to the pivot member being rotated.

The handle assembly further includes a main handle fixed to the door, with the lever being disposed between the main handle and the door. The main handle comprises a fixing part received in a space of the door, and a grasping part (to be grasped by the user) integrally bent downwardly from the fixing part, the grasping part extending out of the door.

The lever is provided with a coupling member which is pivotally inserted into a coupling groove formed on a lower end of the grasping part, the coupling member including pins which fixedly mount the main handle on the door.

The pivot member comprises a hook disposed in a space defined between the lever and the grasping member of the main handle, side plates integrally extending from respective both sides of the hook so as to receive the operating member therebetween, pivot projections projecting outward from the side plates and pivotally coupled on the door, and a depressing member formed on the upper end of the hook so as to depress the operating member toward the main body when opening the door.

The operating member comprises a pushing part for pushing against the main body when opening the door, an operating part integrally connected to the pushing part, and an elastic part integrally formed with the operating part such that when the door is closed, it can return the pushing part to its initial position while biasing against an outer surface of the door, whereby the gasket tightly contacts the main body.

Preferably, a cross sectional area of the pushing part is larger than that of the operation part, and a reinforcing member is disposed between the pushing part and the operating part.

Preferably, friction reducing means for reducing friction force between the operating member and a wall defining the space is provided on a surface of the operating part of the operating member.

The friction reducing means is selected from the group consisting of a ball bearing and a roller.

Shock absorbing means for absorbing shock when the operating member pushes the main body to prevent a surface of the main body from being damaged is provided on the pushing part.

BRIEF DESCRIPTION OF THE DRAWINGS

The above object, and other features and advantages of the present invention will become more apparent by describing in detail preferred embodiments thereof with reference to the attached drawings, in which.

DETAILED DESCRIPTION OF PREFERRED EMBODIMENTS

Preferred embodiments of the present invention will now be described in detail with reference to the accompanying drawings.

Figure 1:
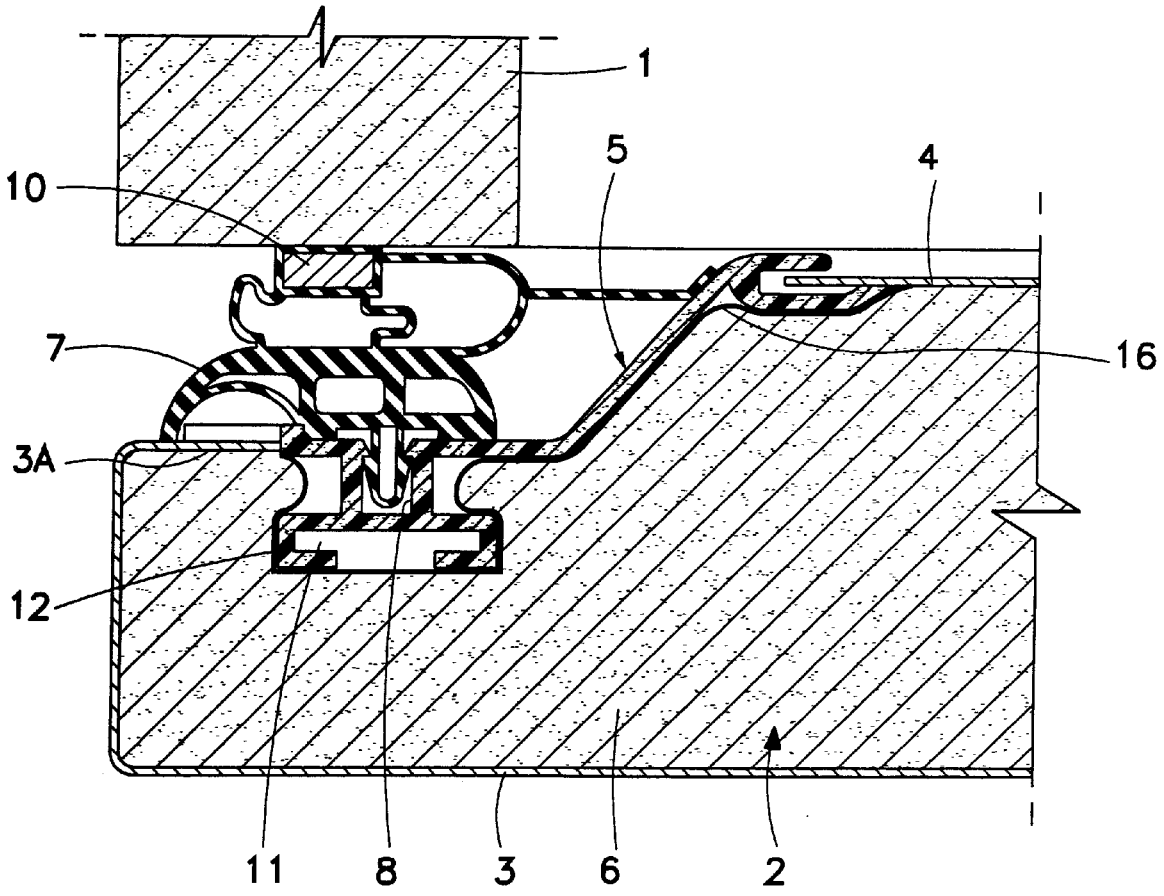
FIG. 1 (PRIOR ART)
FIG. 1 is a partial sectional view illustrating a door assembly of a conventional refrigerator.
Figure 2:
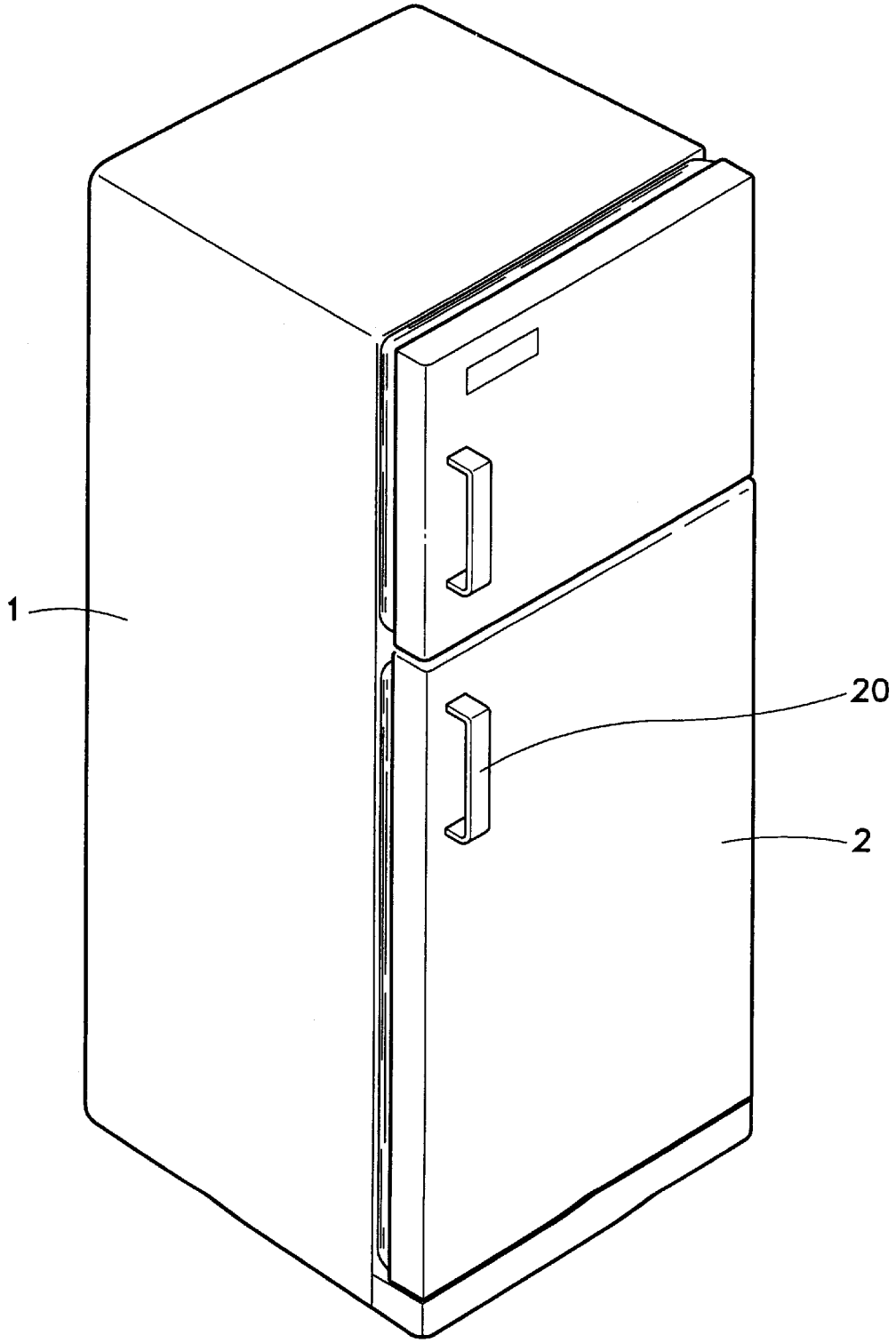
FIG. 2 (PRIOR ART)
FIG. 2 is a perspective view illustrating a conventional refrigerator and door handle.
Figure 3:
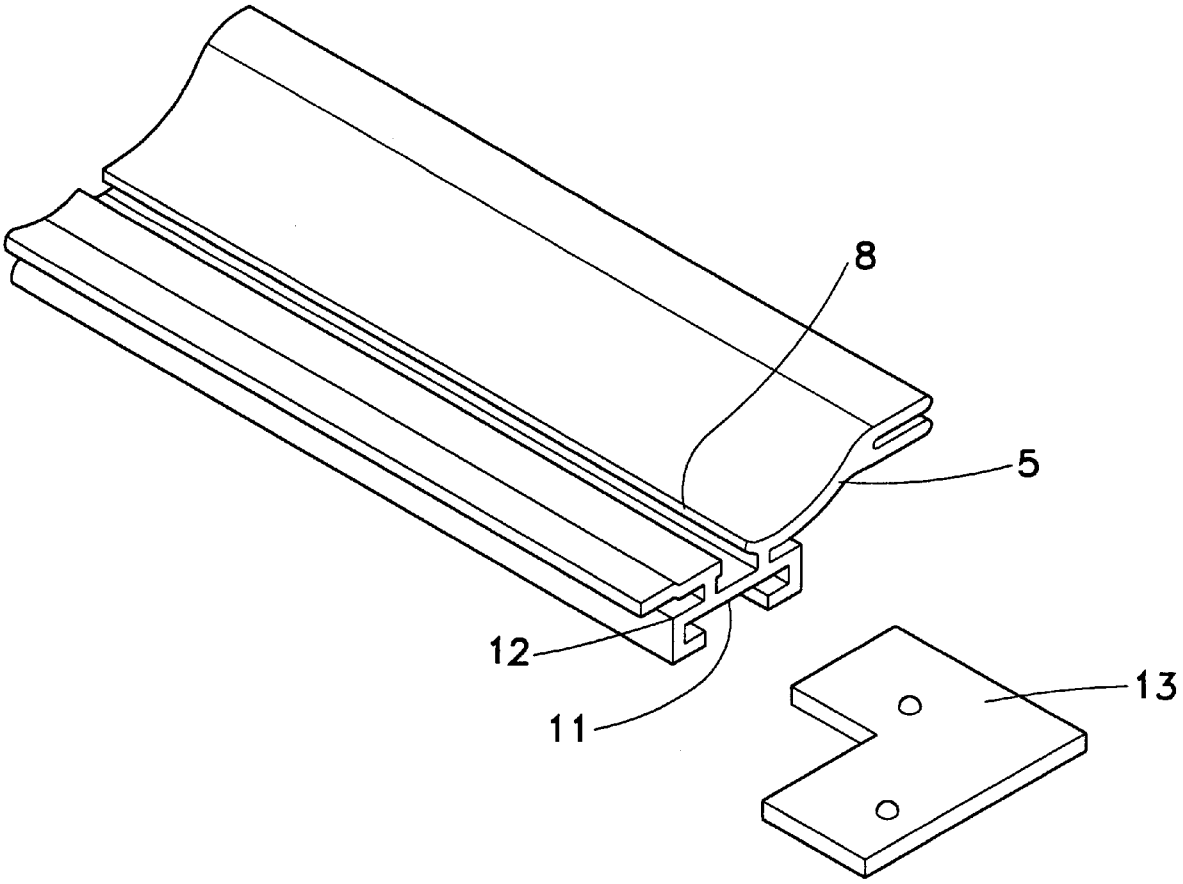
FIG. 3 (PRIOR ART)
FIG. 3 is an exploded perspective view illustrating a conventional door handle.
Figure 4:
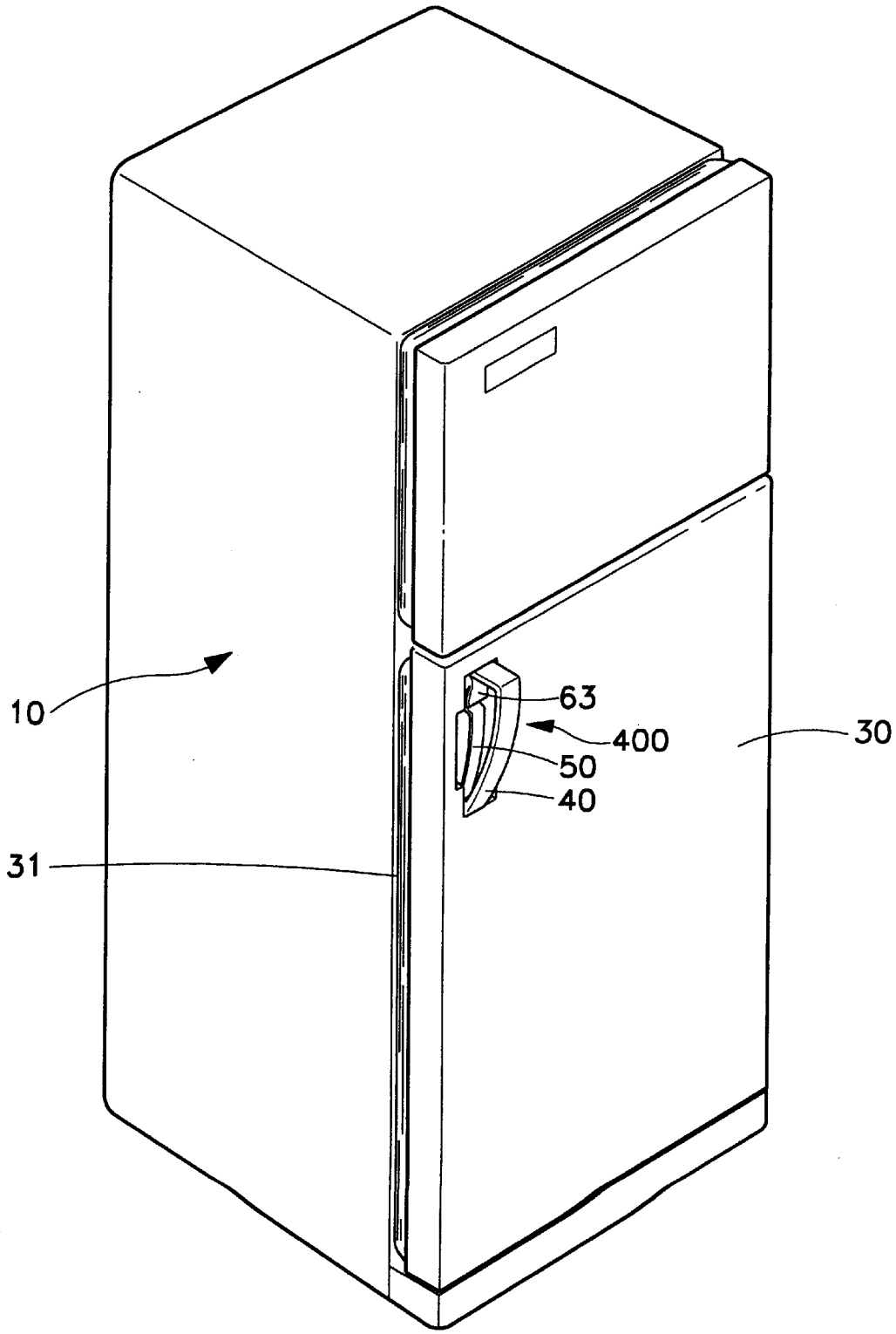
FIG. 4 is a perspective view illustrating a refrigerator having a door handle assembly according to a preferred embodiment of the present invention.

Referring first to FIG. 4, there is shown a perspective view of a refrigerator having a preferred door handle assembly according to the present invention.

The refrigerator comprises a refrigerator main body 10 defining an interior 20, a door 30 hingedly mounted on the main body 10 so as to open and close the interior 20, a door handle assembly 400 for opening and closing the door 30, and a sealing gasket 31 mounted on the door 30 so that when the door 30 is closed leakage of cooled air is prevented. The gasket 31 is made of a rubber material which can tightly seal the interior 20 of the refrigerator.

Figure 6:
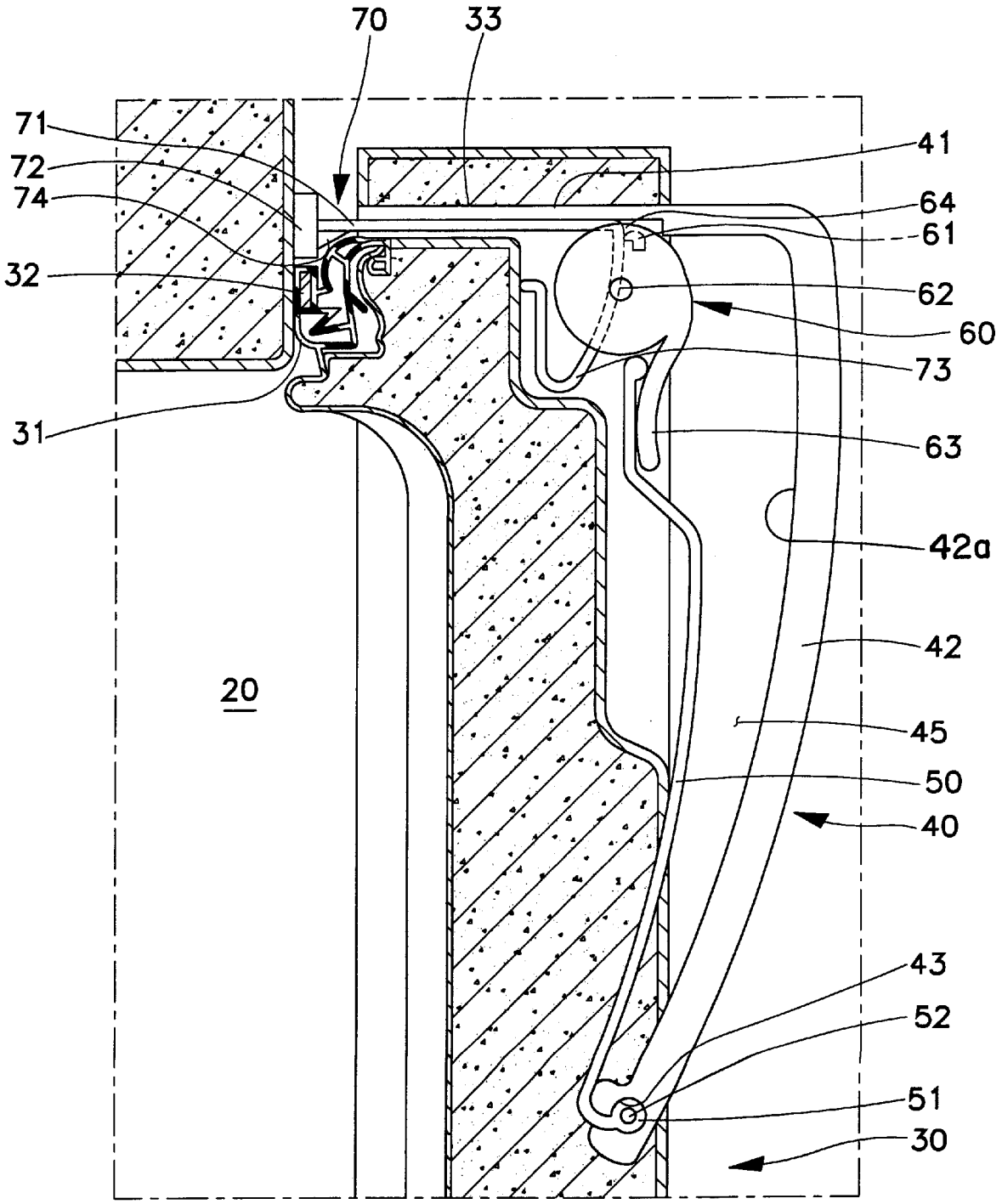
FIG. 6 is a partial sectional view illustrating a door handle assembly according to a preferred embodiment of the present invention when a door is closed.

As shown in FIG. 6, a magnet 32 allowing the gasket 31 to maintain a surface-contact state with the main body 10 when the door 30 is closed is mounted within the gasket 31.

In addition, the door 30 is provided with a handle operation space 33 for receiving operating means of the door handle assembly 400.

Figure 5:
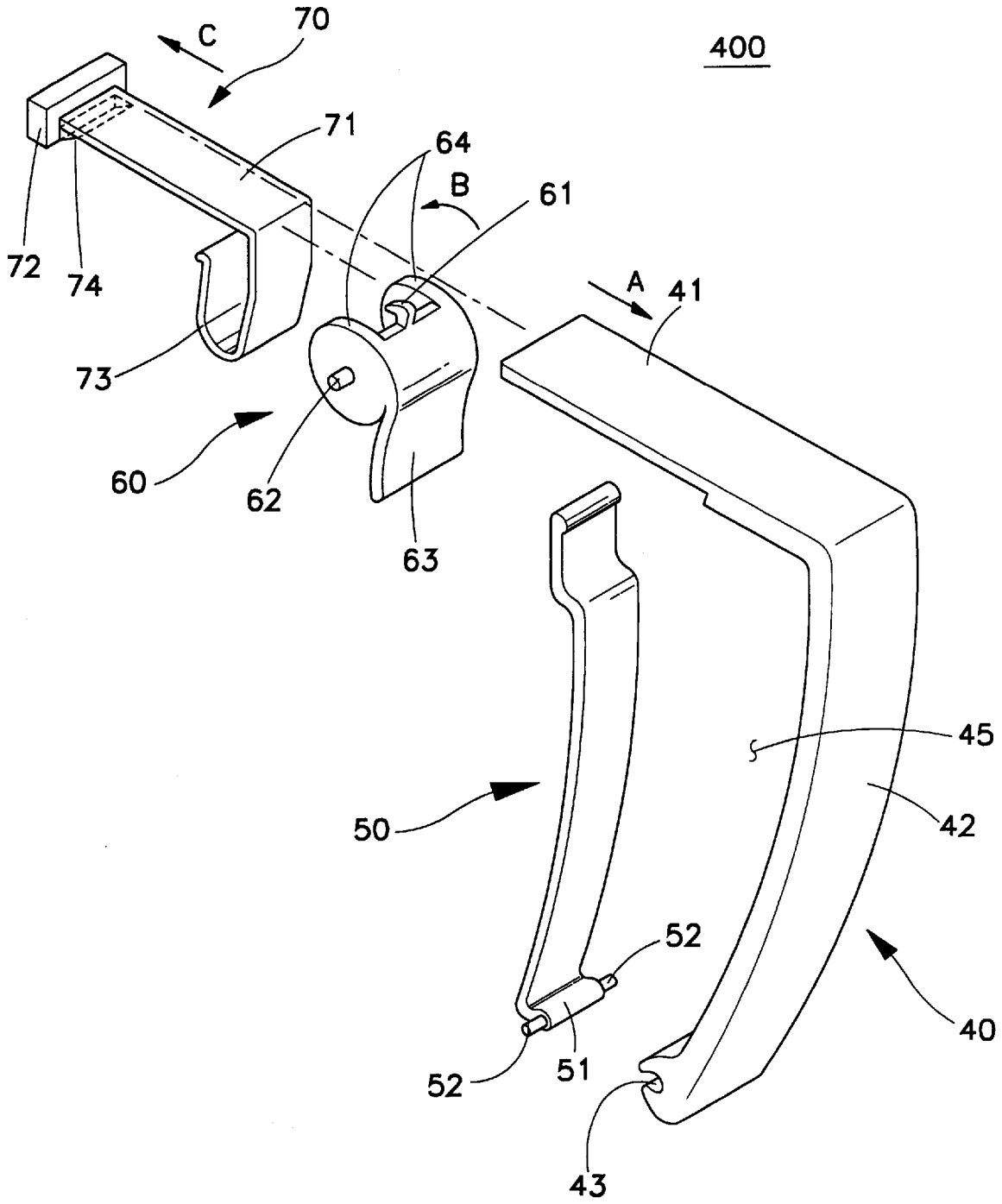
FIG. 5 is an exploded perspective illustrating a door handle assembly according to a preferred embodiment of the present invention.

Referring to FIG. 5, the door handle assembly 400 comprises a lever 50, a pivoting member 60, and an operating member 70. The main handle 40 includes a first end defined by an upper fixing part fixed in the handle operation space 33 of the door 30 and a grasping part 42, which is grasped by the user, integrally bent downwardly from and formed in one piece with the upper part 41. The grasping part is disposed between the first end and a lower second end of the handle. An actuator in the form of the lever 50 is pivotally coupled on the main handle 40 in opposing relationship to an inner surface 42*a* thereof. The pivot member 60 is rotatably disposed between the grasping member 42 and the lever 50 for converting rotation of the lever into linear movement of the operating member. That is, the operating member 70 is linearly moved in accordance with a rotation of the pivot member 60 to push against the main body 10 such that the gasket 31 is more easily released from the main body.

The lever 50 includes a manually grippable portion 51*a* and coupling member 51 which is pivotally inserted into a coupling groove 43 formed on the lower end of the grasping member 42. Pins 52 are integrally formed on the coupling member 51 and project outwardly therefrom, the pins 52 functioning as fixing means for fixing the lever 50 and the handle 40 on the door 30. The lever 50 is disposed in a recess 30*a* formed in the door.

The pivot member 60 is designed to pivot when the lever member 50 is pulled. Accordingly, the pivot member 60 comprises an arm such as a hook 63 disposed in a space 45 defined between the lever 50 and the grasping member 42 of the main handle 40. Side plates 64 integrally extend from respective sides of the hook 63 to form a recess receiving the operating member 70. Pivot projections 62 (only one shown in the drawing) project outward from the side plates 64 and are pivotally coupled on the door 30. A depressing member 61 is formed on the upper end of the hook 63 so as to depress the operating member 70 when opening the door 30, i.e., when the lever 50 is pulled by the user.

From the closed state, the door 30 is designed to be opened when the operating member 70 is operated by the pivot member 60. The operating member 70 comprises a pushing part 72 for pushing against the main body 10, an operating part 71 integrally connected to the pushing part 72, and an elastic end 73 integrally formed with the operating part 71 such that when the door 30 is closed, it defines an elastic end of the operating member 70 which can return the pushing part 72 to its initial position while biasing against the outer surface of the door 30, whereby the gasket 31 tightly contacts the main body 10. A reinforcing flange 74 extends between the pushing part 72 and the operating part 71. The pushing part 72 comprises a piece of flexible material mounted on a pushing end of the operating member.

The operation of the above described handle assembly 400 will be described hereinafter.

When the door is closed, the pushing part 72 is spaced from the main body 10 by the elastic force of the elastic member 73 of the operating member 70 and, at the same time, the gasket 31 is held in surface contact with the main body 10 by the magnet 32 installed within the gasket 31.

From this state, when opening the door 30, if the user pulls against the lever and rotate the lever 50 clockwise in FIG. 6, the upper end of the lever 50 moves in the direction of an arrow A in FIG. 5. As a result, the pivot member 60 is rotated counterclockwise (in the direction of arrow B). That is, the upper end of the lever 50 pulls the hook 63 toward the grasping member 42, thereby pivoting the pivot member 60 in the direction of the arrow B.

Figure 7:
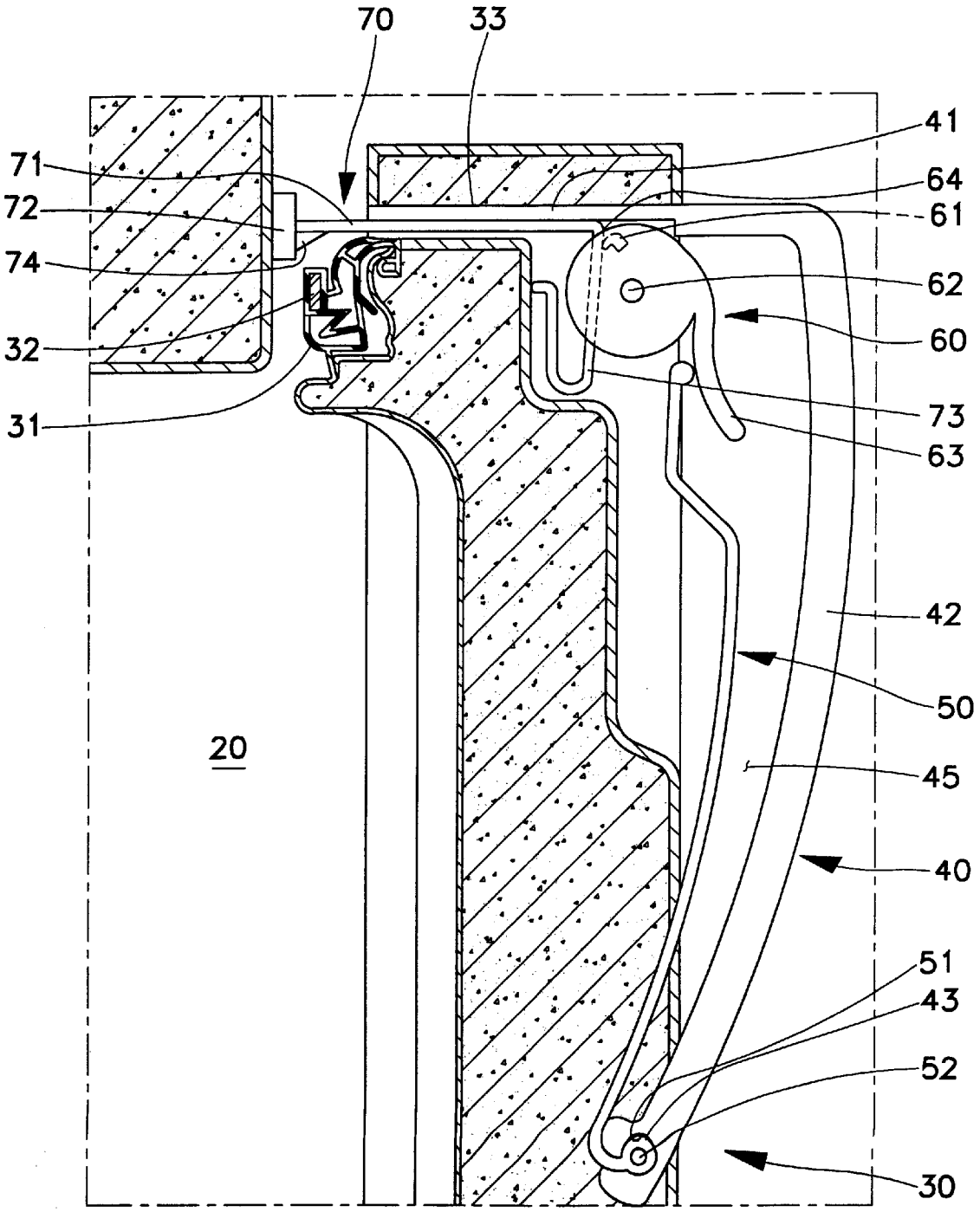
FIG. 7 is a partial sectional view illustrating a door handle assembly according to a preferred embodiment of the present invention when a door is opened.

As a result, the depressing member 61 depresses the elastic member 73 so that the operating member 70 moves linearly in the direction of an arrow C, whereby the pushing part 72 of the operating member 70 pushes on the main body 10 to detach the gasket 31 from the main body 10 (see FIG. 7), and thus enable the door to be more easily opened.

In addition, when closing the door 30, as shown in FIG. 6, the pivot member 60 is returned to its initial position by the restoring force of the elastic member 73, and the pushing part 72 is moved in a direction toward the door 30. Therefore, the gasket 31 containing the magnet 32 surface-contacts the main body 10, keeping the door in the closed state.

Figure 8:
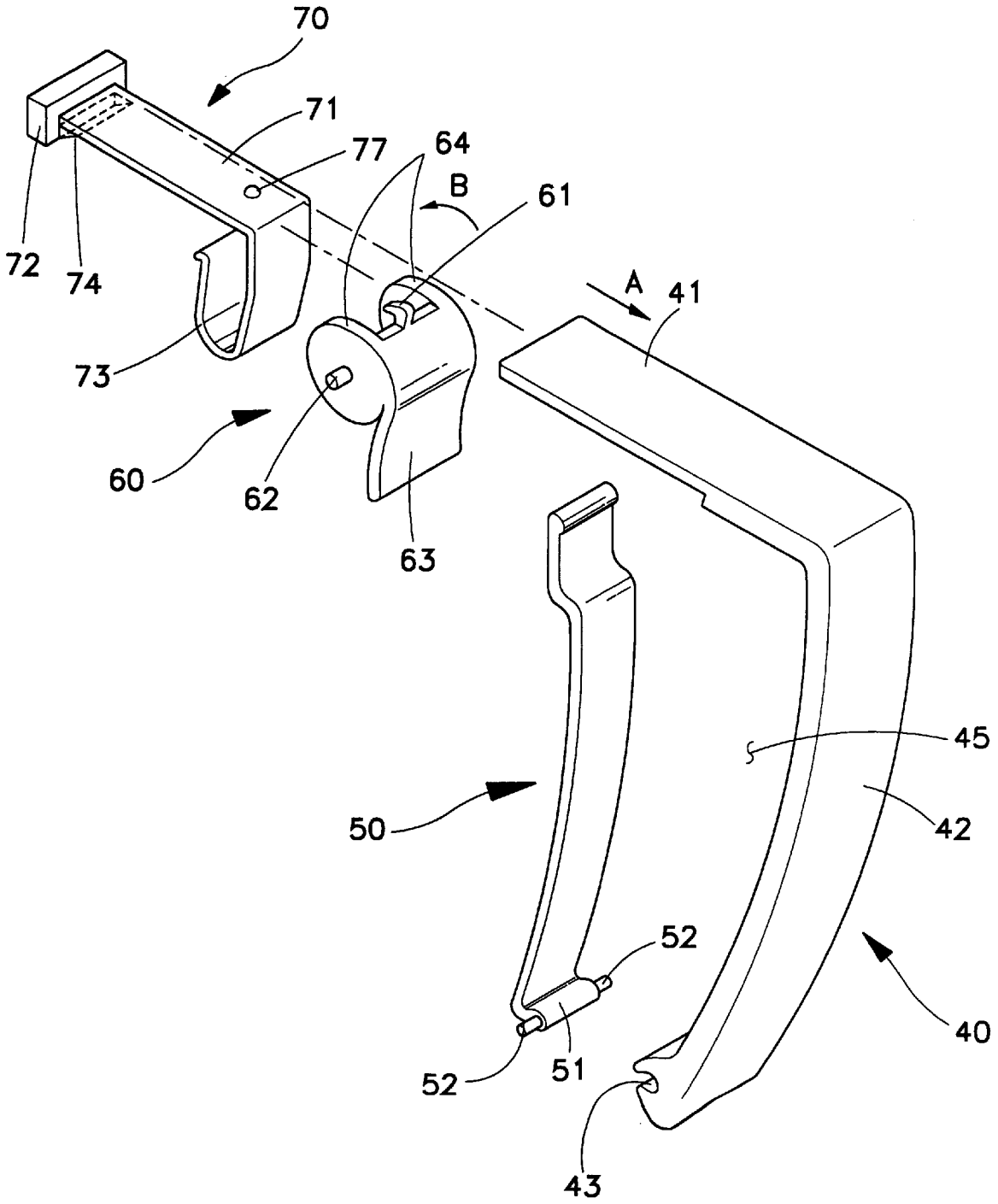
FIG. 8 is an exploded perspective illustrating a door handle assembly according to another preferred embodiment of the present invention.
Figure 9:
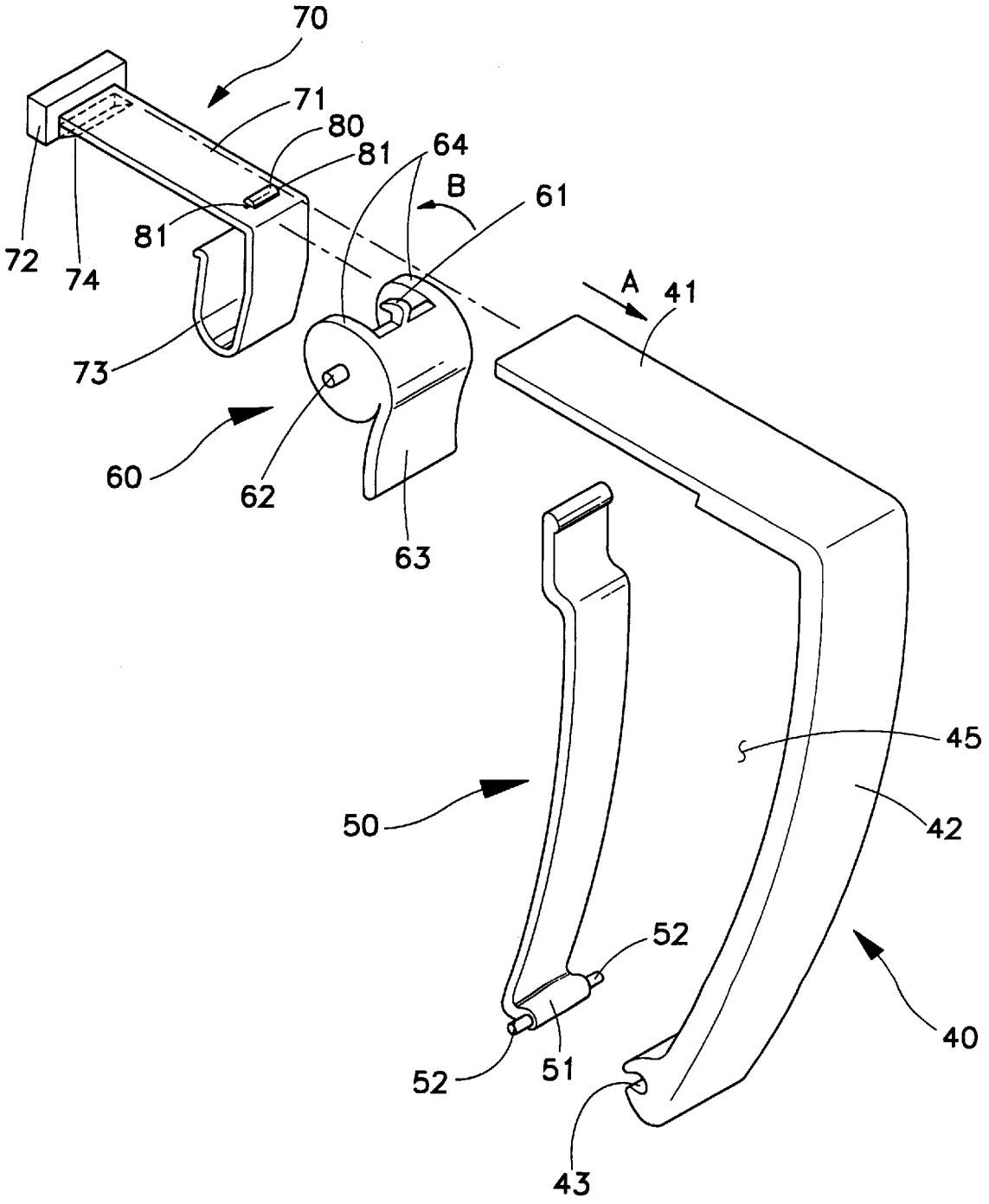
FIG. 9 is an exploded perspective illustrating a door handle assembly according to still another preferred embodiment of the present invention.

Referring to FIGS. 8 and 9, there are shown perspective views illustrating a handle assembly according to other embodiments of the present invention. In FIG. 8, there is provided friction reducing means such as a ball bearing 77, and in FIG. 9 a roller 80 is provided on an upper surface of the operating part 71 of the operating member 70 with opposite ends 81 thereof being rotatably mounted on the operating member. The above friction reducing means allows the operating member to more smoothly operate in the space 33.

Figure 10:
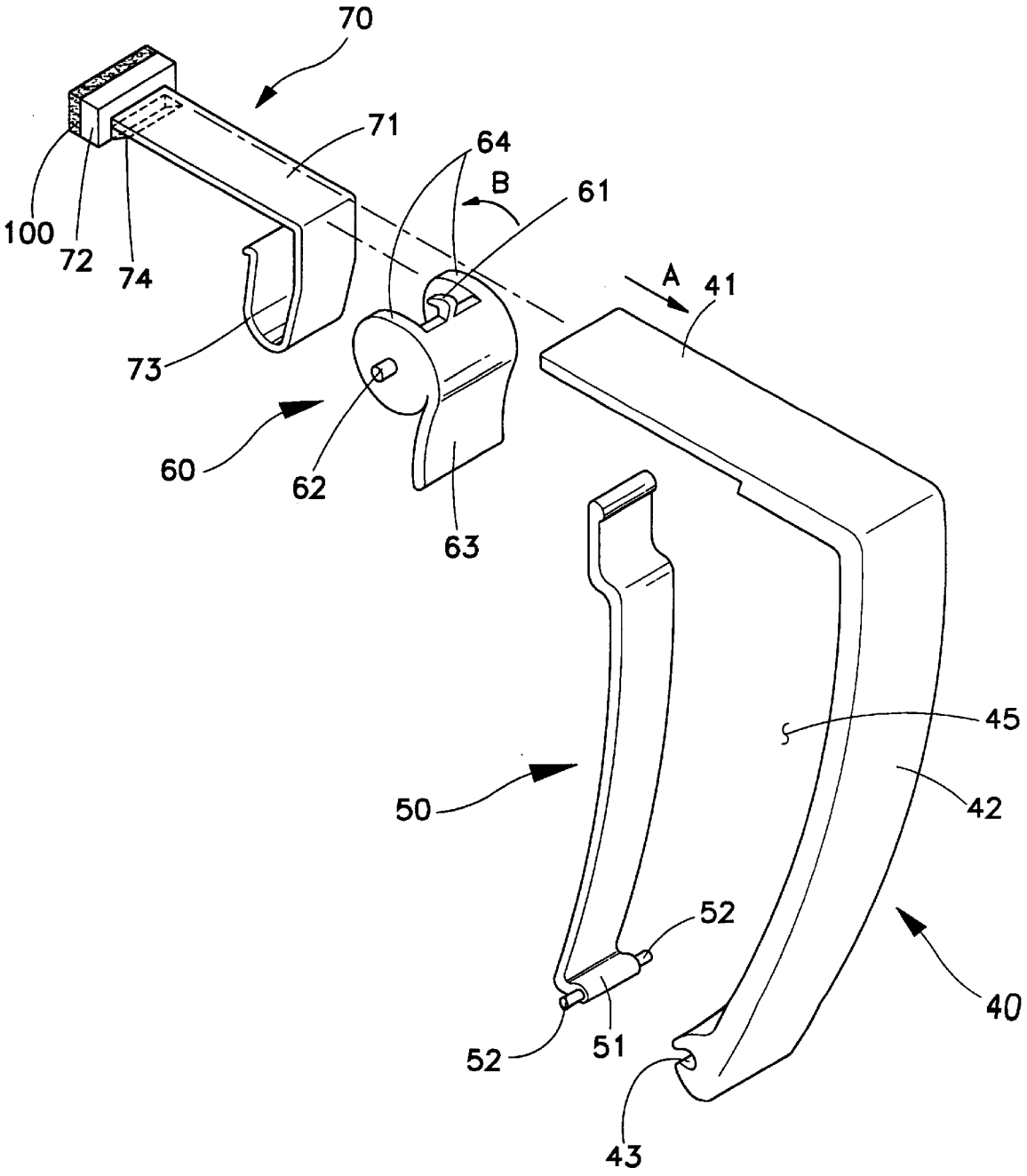
FIG. 10 is an exploded perspective illustrating a door handle assembly according to yet another preferred embodiment of the present invention.

Referring to FIG. 10, there is shown a perspective view illustrating a handle assembly according to yet another embodiment of the present invention. The difference between this embodiment and the preceding embodiments is that there is provided a shock absorbing member 100 on the pushing part 72 of the operating member 70. The shock absorbing member 100 is attached on a surface of the pushing part 72 such that it can absorb shock to prevent the main body from being damaged when the pushing part 72 is pushed against the main body 10. Preferably, the shock absorbing member 100 is made of rubber or polyurethane or polypropylene material.

While the invention has been described in connection with what is presently considered to be most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. A refrigerator comprising:

A) a main body;

B) a door hinged to the main body;

C) a gasket disposed between the main body and the door in sealing contact therewith when the door is closed; and D) a handle assembly mounted on the door for enabling a user to open the door, the handle assembly including:

D1) a main handle having opposite ends fixed to the door, and

D2) a lever including:

D2i) a manually grippable portion disposed between the main handle and the door, and D2ii) a mounting structure pivotably mounting one end of the lever to the door to enable the lever to rotate relative to both the door and the main handle in response to the manually grippable portion being gripped by a user, the mounting structure fixing one of the ends of the main handle to the door;

D3) an operating member linearly movable into pressing contact against the body for creating a force tending to separate the gasket from the body; and D4) a force transmitting mechanism operably connected between the lever and the operating member for converting rotary movement of the lever into linear movement of the operating member, the force transmitting mechanism comprising a pivot member mounted on the door for rotation relative thereto, the pivot member being operably connected to the manually grippable portion of the lever for being rotated thereby, and operably connected to the operating member for linearly moving the operating member in response to the pivot member being rotated.

2. The refrigerator according to claim 1 wherein the lever is disposed within a recess formed in the door.

3. The refrigerator according to claim 2 wherein the main handle includes a manual grasping part disposed between the ends of the main handle, the manually grippable portion of the lever being disposed between the door and the manual grasping part of the main handle.

4. The refrigerator according to claim 3 wherein an end of the lever is disposed opposite the mounting structure and constitutes a free end movable toward and away from the manual grasping part of the main handle; the pivot member including an arm extending between the free end of the lever and the manual grasping part of the main handle to be displaced by the free end of the lever when the lever is pivoted toward the grasping part.

5. The refrigerator according to claim 4 wherein the pivot member includes a recess in which an end of the operating member is disposed, the pivot member including a depressing member arranged to depress the operating member linearly toward the body in response to rotation of the pivot member.

6. The refrigerator according to claim 3 wherein the operating member includes a pushing end for pushing against the body, and an elastic end for applying a spring force for biasing the pushing end away from the body.

7. The refrigerator according to claim 6 wherein the operating member includes an operation part interconnecting the pushing end and the elastic end; the pushing end having a larger cross sectional area than the operation part.

8. The refrigerator according to claim 6 wherein the operating member includes an operation part interconnecting the pushing end and the elastic end; the operation part arranged to slide in a space disposed in the door; and anti-friction means disposed between the operation part and a portion of the handle to facilitate sliding movement of the operation part.

9. The refrigerator according to claim 8 wherein the anti-friction means comprises a ball bearing.

10. The refrigerator according to claim 8 wherein the anti-friction means comprises a roller.

11. The refrigerator according to claim 3 wherein the operating member includes a shock absorber for absorbing shock generated in response to engagement between the operating member and the body.

12. The refrigerator according to claim 11 wherein the shock absorber comprises a piece of flexible material disposed on a pushing end of the operating member.

13. The refrigerator according to claim 12 wherein the flexible material comprises rubber.

14. The refrigerator according to claim 12 wherein the flexible material comprises polyurethane.

15. The refrigerator according to claim 12 wherein the flexible material comprises polypropylene.

* * * * *